US005439039A

United States Patent [19]

Bradstreet, Jr. et al.

[11] Patent Number: 5,439,039

[45] Date of Patent: Aug. 8, 1995

[54] SLABBER WITH FIXED COUNTERKNIFE AND ADJUSTABLE KNIFE AND CLAMP

[75] Inventors: Joseph R. Bradstreet, Jr., Vancouver, Wash.; Keith H. Hewitt, West Linn; David S. Macey, Gladstone, both of Oreg.

[73] Assignee: Pacific Saw and Knife Company d/b/a Pacific/Hoe Saw and Knife Company, Portland, Oreg.

[21] Appl. No.: 298,935

[22] Filed: Aug. 30, 1994

[51] Int. Cl.[6] ..... B27G 13/00

[52] U.S. Cl. ..... 144/220; 144/162 R; 144/218; 144/241; 241/292.1; 241/298; 407/37; 407/40; 407/87; 407/79

[58] Field of Search ..... 407/37, 40, 41, 73, 407/74, 75, 76, 77, 78, 79, 85, 87, 94, 95, 108; 144/162 R, 172, 174, 176, 218, 220, 230, 241; 241/92, 278.1, 292.1, 298; 83/698

[56] References Cited

U.S. PATENT DOCUMENTS

| | | | |
|---|---|---|---|
| 2,623,272 | 10/1952 | Greenleaf | 407/79 |
| 3,694,879 | 10/1972 | Kennicott et al. | 407/79 |
| 3,854,511 | 12/1974 | Maler | 144/230 |
| 4,194,545 | 3/1980 | Kostermeier | 144/230 |
| 4,449,556 | 5/1984 | Colton | 144/230 |
| 4,503,893 | 3/1985 | Demopoulos | 144/241 X |
| 4,977,939 | 12/1990 | Depuy et al. | 144/241 |
| 5,076,503 | 12/1991 | Cook | 144/230 |
| 5,271,440 | 12/1993 | Bradstreet, Jr. et al. | 144/176 |
| 5,271,442 | 12/1993 | Carpenter et al. | 144/220 |

*Primary Examiner*—W. Donald Bray
*Attorney, Agent, or Firm*—Klarquist Sparkman Campbell Leigh & Whinston

[57] ABSTRACT

A log-slabbing chipper with multiple knife structures distributed about the periphery of a power-driven rotor head. Each knife structure includes a holder and a pair of assemblies mounting double-edge replaceable knives. Each knife is mounted between a clamp and a fixed counterknife. Each knife has a serrated back-bearing surface and each clamp has a correspondingly serrated clamping surface. Adjusting screws exert pressure on the clamps to slide the clamps and the knives with respect to the stationary counterknives to achieve desired precise edge positions.

3 Claims, 3 Drawing Sheets

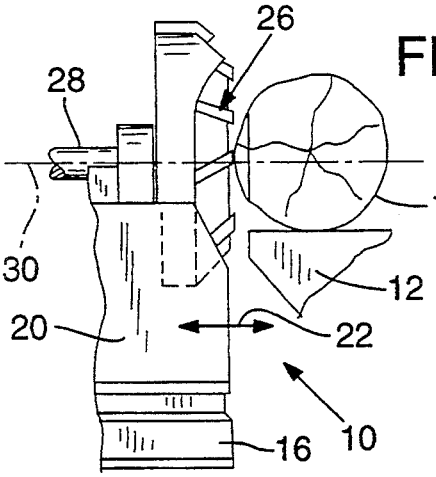
FIG. 1
FIG. 2
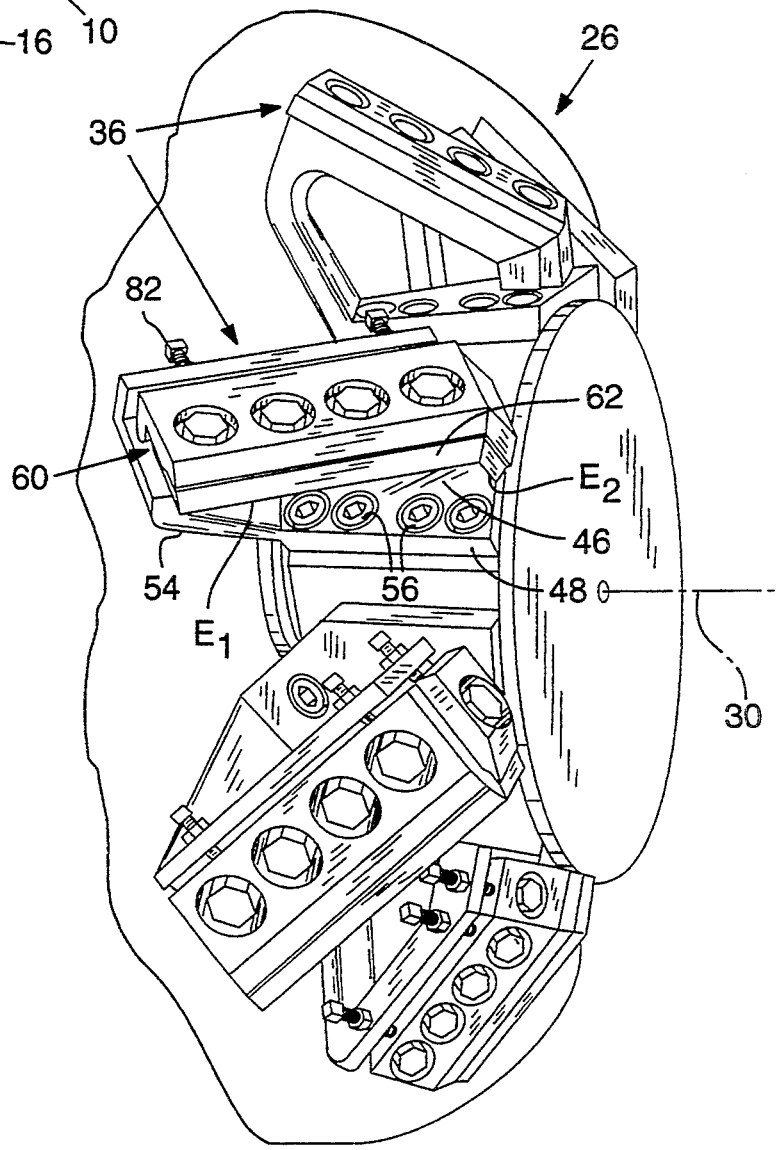

SLABBER WITH FIXED COUNTERKNIFE AND ADJUSTABLE KNIFE AND CLAMP

FIELD OF THE INVENTION

This invention relates to log-slabbing chippers and, more particularly, to chippers which are generally known as "bent knife slabbers".

BACKGROUND OF THE INVENTION

A log-slabbing chipper generally includes a power-driven rotor head disposed to one side of a log support. The head supports knife structures on its periphery. These operate to chip wood material from a log upon relative movement of the head with respect to the log. In such a chipper, the knife structures on the head are rotated against the side of the log to produce the chips. Each knife Structure generally includes one knife moving in a conical cutting path, which functions to cut chips as the head is rotated and moved along the side of the log. The structure further includes a second knife known as a planing edge, which moves in a plane parallel to the axis of the log and planes a flat surface on the log as the chips are cut by the conically rotating knife. Obviously, the knives used in chippers of this type must be kept sharp for efficient and accurate cutting. Also, it is important to position the edges of the knives extremely accurately if uniform chips are to be obtained.

In 1971, The Filer and Stowell Company, Milwaukee, Wis., manufactured and sold a headrig chipper known as its model CHS. This chipper had cutterheads with replaceable knife holders. Each holder carried a chipper knife and a facing knife. Each knife was supported by a knife clamp, a counterknife and, of course, the necessary bolts. The knives were straight and each was mounted on a counterknife and held in position by the clamp. Accurate positioning of a knife in between its respective counterknife and clamp was achieved using Babbitt metal. Because of this, adjusting the position of a knife required changing the Babbitt metal. Thus, accurate realignment of knives after grinding was difficult and inefficient to achieve.

Carpenter et al., U.S. Pat. No. 5,271,442, disclosed a log-slabbing chipper utilizing double-edged reversible and disposable chipper knives. The Carpenter et al. assembly featured a knife having an elongated key-receiving channel on one of its sides. The channel was relied upon to position the knife accurately with respect to a knife support. While the assembly provides a double-edged knife which can be securely mounted, the knife itself cannot be reground and sharpened on its primary bevel while maintaining its cutting edge in its original position. This is because of the ridge or key in the knife support, which fits within the groove or keyway in the knife. By its very nature, a key and keyway construction preclude relative motion between a knife and its underlying knife support. The Carpenter et al. assembly achieved adjustment of its knives by means of screws which exerted pressure on the underlying knife supports.

In our U.S. Pat. No. 5,271,440, we disclosed a knife assembly for a wood chipper which used a reversible disposable knife having a serrated back-bearing surface positioned between a serrated knife clamp and a flat counterknife. The knife can be reground and advanced along the serrated clamping surface of the clamp so as to maintain a desired edge position with respect to a workpiece support. Use of such serrated knives makes it possible to achieve four cutting cycles for each one, rather than the two that are possible with the Carpenter et al. assembly, yet the edge of a reground knife has the correct relative position with respect to the workpiece support even after regrinding. Each knife thus has twice the cutting life of previously known knives. Furthermore, the absence of serrations on the counterknives, together with the corresponding absence of serrations on the front sides of the knives themselves, results in knives that can be reground without the serrations interfering with the grinding of new relief surfaces. All this avoids deleterious cutting action, as well as the production of erratic-sized chips.

It is thus a principal object of the present invention to provide a log-slabbing chipper of the bent knife type with a serrated double-edged chipper knife of the type disclosed in our aforementioned U.S. Pat. No. 5,271,440.

It is a further object of the present invention to provide a log-slabbing chipper of the aforementioned type whereby each clamp and knife is adjustable with respect to a workpiece support without the necessity of adjusting the supporting counterknife.

SUMMARY OF THE INVENTION

The log-slabbing apparatus of the instant invention includes a log-supporting means having a station occupied by a log being processed. A power-driven rotor head is positioned adjacent one side of the station. The rotor head and the log-supporting means are relatively movable in a direction parallel to the axis of a log supported by the log-supporting means.

At least one holder is mounted on the rotor head. As is usual with bent knife slabbers of this type, first and second double-edged knives are disposed on the holder with an end of the first knife positioned adjacent an end of the second knife, and with the edges of the first and second knives facing in the same direction. The edge of the first knife moves in a conical cutting path with rotation of the rotor head. The edge of the second knife moves in a planar cutting path upon relative movement of the rotor head parallel to the axis of the log.

A first knife-mounting assembly is disposed on a first surface of the holder. The first knife-mounting assembly comprises a first counterknife fixedly mounted to the first surface of the holder. A first knife clamp mounts the first knife on the first counterknife, with the first knife being clamped between the first knife clamp and the first counterknife. The first knife clamp is provided with a first abutment surface positioned generally perpendicularly to the first surface of the holder. A second knife-mounting assembly is disposed on a second surface of the holder, the second knife-mounting assembly being similar to the first one, with the exception that the second knife is movable in a planar cutting path instead of in the aforementioned conical cutting path.

Adjusting screws threadedly received in the holder exert adjusting pressure on the abutment surfaces of the first and second knife clamps. This makes it possible to slide the first and second knife clamps with respect to the first and second counterknives, thereby to adjust the positions of the edges of the first and second knives with respect to the holder, yet without the necessity of adjusting the positions of the respective counterknives.

Desirably, the first and second abutment surfaces of the first and second knife clamps each comprises a shoulder extending perpendicularly to the first and second surfaces of the holder. The adjusting screws exert adjusting pressure on the respective shoulders.

The double-edged knives contemplated for use with this invention are as disclosed in our aforementioned U.S. Pat. No. 5,271,440. Each comprises an elongated knife body bounded on opposite margins by a pair of original elongated cutting edges. Each knife body has a first side defined by a pair of original knife surfaces extending inwardly from the respective cutting edges. Each first side comprises a bearing surface disposed between the original knife surfaces. Each bearing surface includes one pair of indented serrations, each of which is adjacent a respective original knife surface, and a plurality of indented serrations disposed therebetween. Each knife body has a flat second side opposed and parallel to the bearing surface of the first side.

Each knife clamp comprises a clamping surface. Each clamping surface has protruding serrations thereon. Each clamping surface bears against the bearing surface of the respective knife, with the protruding serrations on the clamping surface of the clamp cooperatively engaging the indented serrations on the bearing surface of the knife. Each clamp holds its respective knife with one of its original cutting edges positioned a predetermined distance from the log-supporting means.

The serrations on the bearing surface of the knife are so positioned that when the original knife surfaces are reground an amount that bisects the one pair of indented serrations adjacent the original knife surfaces, thereby to form new knife surfaces and new cutting edges, the bearing surface of the knife can be advanced with respect to the serrated clamping surface of the clamp, whereby a new cutting edge is positioned at the aforesaid predetermined position of the original cutting edge.

The construction makes it possible to advance the serrated bearing surface of the knife with respect to the serrated clamping surface of the clamp without otherwise affecting the counterknife. In this way, the edges of the knife may be reground, yet the position of the cutting edge of the knife may be maintained at the desired location with respect to the log-supporting means. The absence of serrations on the counterknife results in an assembly wherein the front side of the knife is free of serrations which would otherwise interfere with the grinding of edge-relief surfaces and which might interfere with its cutting action. The counterknife is correspondingly free of serrations which also could produce erratically sized chips.

BRIEF DESCRIPTION OF THE DRAWINGS

FIG. 1 schematically illustrates a log-slabbing chipper in which the present invention may be used.

FIG. 2 is a perspective view of a power-driven rotor head and multiple knife structures on the rotor head distributed about its periphery so as to produce chips and cut wood as the rotor head revolves.

DETAILED DESCRIPTION OF THE PREFERRED EMBODIMENT

Figure 3:
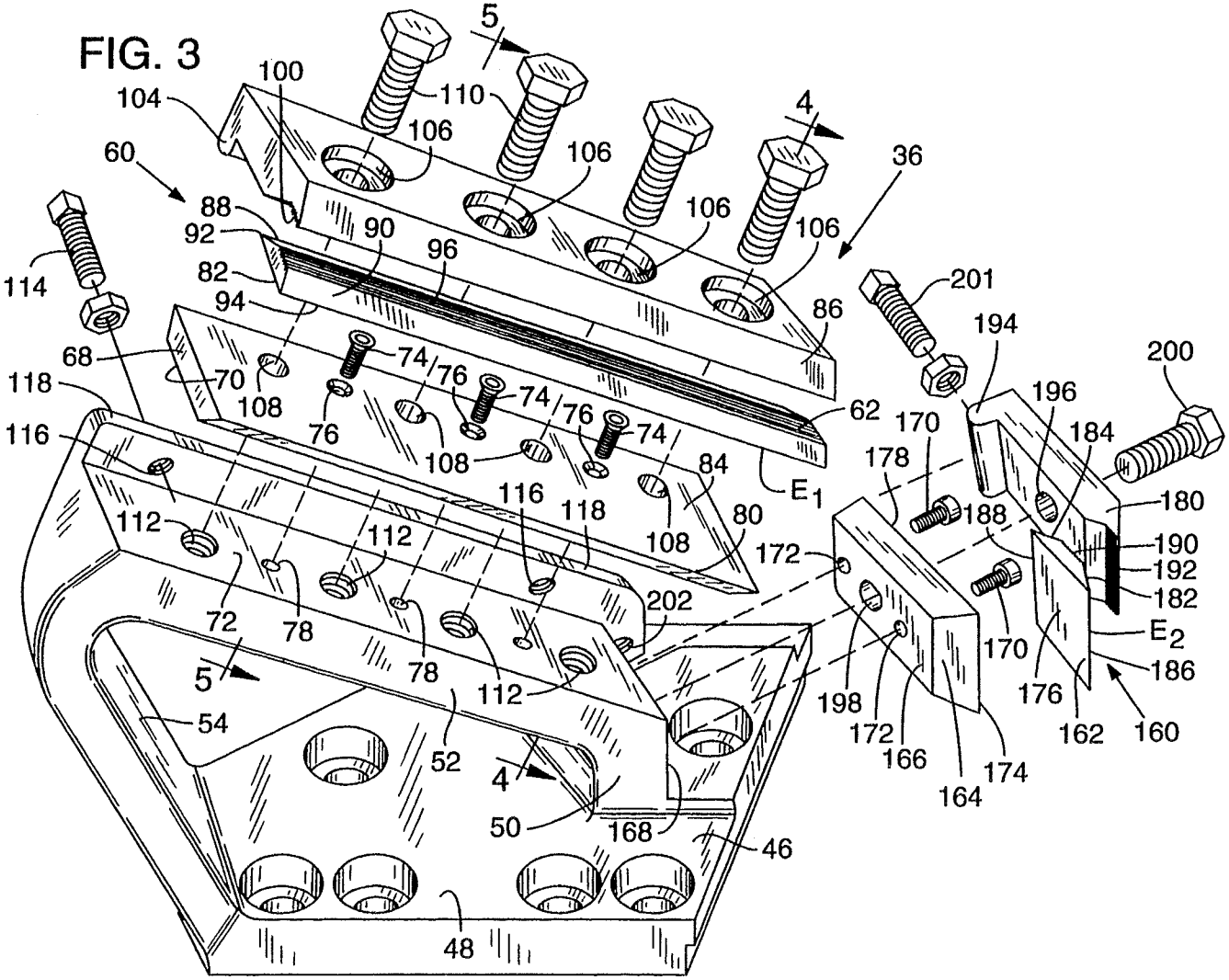
FIG. 3 is an exploded view of one of the knife structures of FIG. 2, including a holder and a pair of mounting assemblies secured thereto.

Referring now to the drawings, a log-slabbing chipper 10 is illustrated schematically in FIG. 1. The chipper includes a log-supporting means in the form of a carriage 12 which mounts a log 14. Carriage 12 and log 14 are movable in a direction extending longitudinally of the log or toward and away from the viewer as the log and carriage are illustrated in FIG. 1.

A frame 16 supports a stand 20 which is slidably mounted on frame 16 such that it can move toward and away from log 14 in the direction indicated by arrow 22. A power-driven rotor head 26 is rotatably supported on stand 20 and is rotated by suitable motor means (not shown) on a shaft 28 about axis 30.

A plurality of knife structures 36 are mounted on head 26 circumferentially around axis 30. Each knife structure 36 mounts a pair of double-edged knives. One knife has an edge $E_1$ and the other knife has an edge $E_2$. Edge $E_2$ is disposed in a plane perpendicular to axis 30. Edge $E_1$, which is considerably longer than edge $E_2$, is disposed at an obtuse angle with respect to edge $E_2$. When rotor head 26 rotates, edge $E_2$, which is a planing edge, planes a smooth, flat surface on log 14. Edge $E_1$, together with its other counterpart edges on head 26, rotates on a conical surface, and operates to cut chips from log 14.

Figure 4:
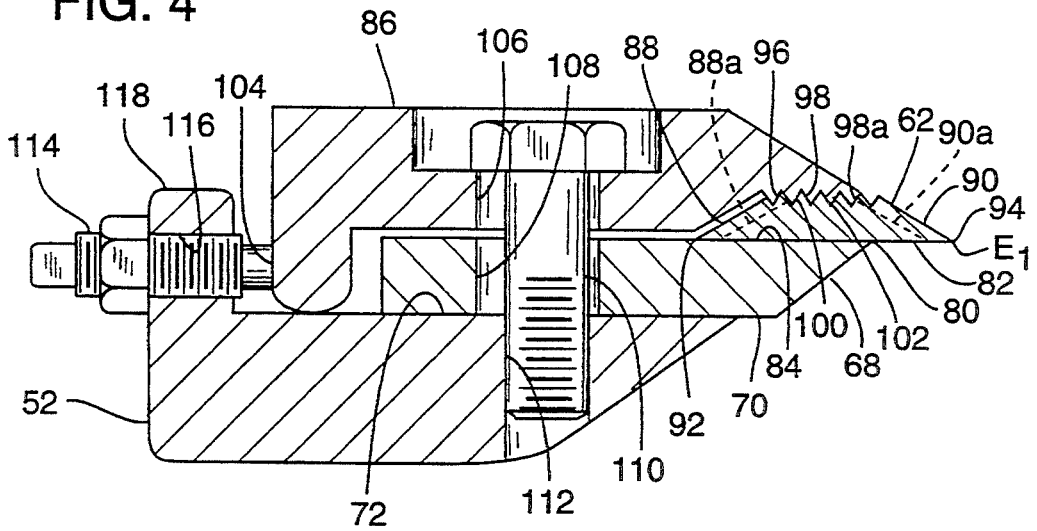
FIGS. 4 and 5 are cross-sectional views taken along lines 4—4 and 5—5 of FIG. 3, respectively, further illustrating the mounting assembly and the knives mounted therein.
Figure 5:
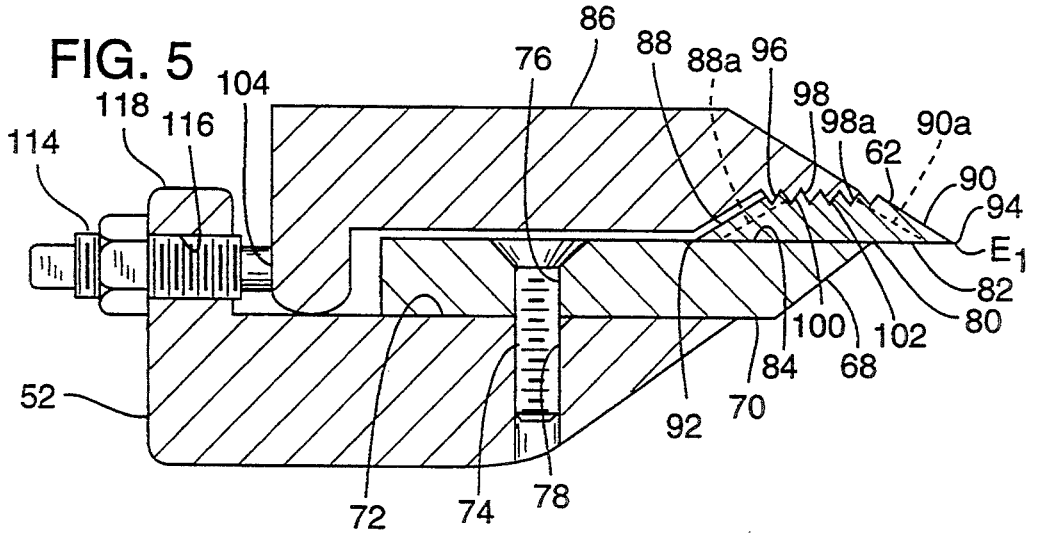

The construction of each knife structure 36 is shown in detail in FIGS. 3, 4 and 5. Each includes a holder 46. Each holder 46 comprises a base 48, an upstanding portion 50, a backing portion 52 integral with and extending at an angle from upstanding portion 50, and a bracing portion 54. Each holder 46 is attached to rotor head 26 by fasteners 56 (see FIG. 2) extending through base 48 and into head 26.

Backing portion 52 supports a first knife mounting assembly 60 which mounts a first double-edged knife 62 having an edge $E_1$, as most clearly shown in FIG. 3. A counterknife 68, having a flat holder-contacting face or side 70, is attached to a mating surface 72 on backing portion 52 by screw fasteners 74 extending downwardly through countersunk holes 76 in counterknife 68 and into threaded bores 78 in portion 52. Counterknife 68 is thus fixedly mounted to surface 72 such that no relative movement can occur therebetween. Forward edge 80 of counterknife 68 extends beyond holder 46. See FIGS. 4 and 5.

The structure of knife 62 was disclosed in our aforementioned U.S. Pat. No. 5,271,440, the full disclosure of which is herein incorporated by reference.

Knife 62 is supported on counterknife 68 with its front face or side 82 adjacent upper surface 84 of counterknife 68. A knife clamp 86 holds knife 62 firmly against counterknife 68. Clamp 86 is substantially the same length as knife 62 and counterknife 68. As disclosed in aforementioned U.S. Pat. No. 5,217,440, each knife 62 is a symmetrical structure having a pair of surfaces 88, 90 which extend inwardly of its body from its respective cutting edges 92, 94. Surfaces 88, 90 define a bearing surface 96 which includes a plurality of indented serrations 98 disposed along its full length. The flat front side 82 of knife 62 is opposed and parallel to serrated bearing surface 96.

Clamp 86 has a complementary clamping surface 100 which is provided with protruding serrations 102. Surface 100 is adapted to bear against surface 96 of knife 62 with the protruding serrations 102 on clamping surface 100 cooperatively engaging indented serrations 98 of bearing surface 96 of knife 62. Clamp 86 is further provided with an abutment surface in the form of a shoulder 104 which extends generally perpendicularly to surface 72 of holder 46.

Openings of ovate cross-section, illustrated at 106 in clamp 86 and at 108 in counterknife 68, loosely receive the shanks of threaded fasteners 110 which extend through clamp 86 and counterknife 68. The threaded ends of fasteners 110 are received in complementarily threaded bores 112 in portion 52 of holder 46. When fasteners 110 are tightened, serrated clamping surface 100 of clamp 86 is brought firmly against complementarily serrated surface 96 of knife 62 to hold the latter against counterknife 68.

Abutment screws 114 received in threaded bores 116 in a shoulder 118 on backing portion 52 determine the precise position of edge $E_1$ of knife 62 by exerting pressure against shoulder 104 of clamp 110, thereby to slide clamp 86 and cooperatively engaged knife 62 with respect to surface 84 of counterknife 68. Tightening fasteners 110 can then retain the assembly and edge $E_1$ of knife 62 in the desired precise position.

As mentioned in our aforementioned U.S. Pat. No. 5,271,440, each knife 62 has two cutting edges 92, 94, such that the knife can be rotated 180° to present a fresh edge as required when a first edge becomes dull. When both edges 92, 94 are dull, the knife can be removed for sharpening.

Also as mentioned in our aforementioned U.S. Pat. No. 5,271,440, the serrations 98 on knife 62 are positioned such that when surfaces 88, 90 are reground parallel to their original positions, but to new surfaces 88*a* and 90*a* which bisect the sides of the outermost serrations 98*a*, knife 62 may be repositioned and advanced with respect to the serrated clamping surface 100 of clamp 86, such that when fasteners 110 are again tightened, the new edge will be in the identical position with respect to the assembly as the original edge was in the original configuration. The only difference is that flat front side 82 of knife 62 is less wide by the width of two serrations than it was originally, before regrinding. This makes it possible to achieve four cutting cycles for each knife 62, rather than the usual two, yet a reground knife has the same precise relative position as respects holder 46 as was the case with the original edge. Each knife 62 thus has twice the cutting life, and the positions of screws 114 do not have to be adjusted as might otherwise be the case.

A second knife mounting assembly 160 mounts a second double-edged knife 162 having the edge $E_2$, also as shown in FIG. 3. A second counterknife 164, also having a flat holder-contacting face or side 166, is attached to a mating surface 168 on upstanding portion 50 of holder 46 by screw fasteners 170 extending through holes 172 in counterknife 164 into threaded bores (not shown) in portion 50. Counterknife 164 is thus also fixedly mounted to surface 168 such that no relative movement can occur therebetween. Forward edge 174 of counterknife 164 also extends beyond holder 46.

Knife 162 is supported on counterknife 164 with its front face or side 176 adjacent outer surface 178 of counterknife 164. A second knife clamp 180 holds knife 162 firmly against counterknife 164. Clamp 180 is also substantially the same length as knife 162 and counterknife 164, but substantially less than the corresponding parts in first knife mounting assembly 60. Again, each knife 162 is as disclosed in aforementioned U.S. Pat. No. 5,217,440 and has a pair of surfaces 182, 184 which extend inwardly from its cutting edges 186, 188, respectively. Surfaces 182, 184 define a bearing surface 190 which is serrated like bearing surface 96 of knife 62. Side 176 is opposed and parallel to serrated bearing surface 190.

Clamp 180 has a complementary serrated clamping surface 192 adapted to bear against serrated surface 190 with the protruding serrations on clamping surface 192 cooperatively engaging the indented serrations on bearing surface 190. Clamp 180 also has an abutment surface in the form of a shoulder 194, like shoulder 104, which extends generally perpendicularly to surface 168 of holder 46.

Ovate openings 196 in clamp 180 and 198 in counterknife 164 loosely receive the shanks of a threaded fastener 200 which is received in a threaded bore (not shown) in portion 50 of holder 46. When fastener 200 is tightened, serrated clamping surface 192 of clamp 180 is brought firmly against complementarily serrated bearing surface 190 of knife 162 to hold the latter against counterknife 164.

An abutment screw 201, like screw 114, received in a threaded bore 202 in shoulder 118 on backing portion 52, determines the precise position of edge $E_2$ of knife 162 by exerting pressure against shoulder 194 of clamp 180, thereby to slide clamp 180 and cooperatively engaged knife 162 with respect to surface 178 of counterknife 164. Tightening fastener 200 can then retain the assembly and edge $E_2$ of knife 162 in the desired precise position. Knife 162, similar to knife 62 albeit shorter, can be similarly reground and repositioned without the necessity of adjusting the position of its abutment screw.

In the construction described, the two mounting assemblies 60 and 160 support knives 62 and 162 end-to-end, i.e., with their ends adjacent each other, and with their respective exposed edges $E_1$ and $E_2$ facing in the same direction and extending at an obtuse angle with respect to each other.

While a particular embodiment of the invention has been described and illustrated, it is evident that variations and modifications are possible without departing from the invention.

We claim:

1. In log-slabbing chipper apparatus, a log-supporting means having a station occupied by a log being processed;

a power-driven rotor head disposed adjacent one side of the station;

the rotor head and the log-supporting means being relatively movable in a direction parallel to the axis of the log supported by the log-supporting means;

at least one holder mounted on the rotor head;

first and second double-edged knives disposed on the holder with an end of the first knife adjacent an end of the second knife, and with one edge of the first knife facing in the same direction as one edge of the second knife, the one edge of the first knife being movable in a conical cutting path with rotation of the rotor head, and the one edge of the second knife being movable in a planar cutting path with relative movement of the rotor head parallel to the axis of the log;

a first knife-mounting assembly disposed on a first surface of the holder, the first knife-mounting assembly comprising a first counterknife fixedly mounted to the first surface of the holder, and a first knife clamp mounting the first knife on the first counterknife, the first knife being clamped between the first knife clamp and the first counterknife, the first knife clamp being provided with a first abutment surface disposed generally perpendicular to the first surface of the holder;

a second knife-mounting assembly disposed on a second surface of the holder, the second knife-mounting assembly comprising a second counterknife fixedly mounted to the second surface of the holder, and a second knife clamp mounting the second knife on the second counterknife, the second knife being clamped between the second knife clamp and the second counterknife, the second knife clamp being provided with a second abutment surface disposed generally perpendicular to the second surface of the holder; and first and second adjusting screws threadedly received in the holder, each of the adjusting screws being adapted to exert adjusting pressure on the respective first and second abutment surfaces of the first and second knife clamps to slide the first and second knife clamps with respect to the first and second counterknives, respectively, thereby to adjust the positions of the aforesaid one edges of the first and second knives with respect to the holder.

2. The apparatus of claim 1, wherein each of the first and second abutment surfaces of the first and second knife clamps comprises a shoulder extending perpendicularly to the first and second surfaces of the holder, respectively, the first and second adjusting screws being adapted to exert adjusting pressure on each of the respective shoulders.

3. The apparatus Of claim 1, wherein each of the first and second double-edged knives comprises a reversible knife, each knife comprising an elongated knife body bounded on opposite margins by a pair of original elongated cutting edges, each knife body having a first side defined by a pair of original knife surfaces extending inwardly of the knife body from its respective cutting edges, each of said first sides comprising a bearing surface disposed between the pair of original knife surfaces, each bearing surface including one pair of indented serrations, each of which is adjacent a respective original knife surface, and a plurality of indented serrations disposed therebetween, each knife body having a second side opposed and parallel to the bearing surface of the first side; and wherein each of the first and second knife clamps comprises a clamping surface, each clamping surface having protruding serrations thereon, each of the clamping surfaces of each of the clamps being adapted to bear against the bearing surface of the respective knife with the protruding serrations on the clamping surface of the clamp cooperatively engaging the indented serrations on the bearing surface of the knife, each of the clamps clamping its respective knife with one of the original cutting edges of the knife disposed at a predetermined distance from the log-supporting means, the serrations on the bearing surface of each of the knives being so positioned that when the original knife surfaces are reground to form a pair of new knife surfaces which bisect the one pair of indented serrations adjacent the original knife surfaces, thereby to form a pair of new cutting edges, the bearing surface of the knife can be advanced with respect to the serrated clamping surface of the respective clamp, whereby one of the pair of new cutting edges of the knife is disposed at the aforesaid predetermined position of the one original cutting edge of the knife with respect to the log-supporting means.

* * * * *

UNITED STATES PATENT AND TRADEMARK OFFICE

CERTIFICATE OF CORRECTION

PATENT NO. : 5,439,039

DATED : August 8, 1995

INVENTOR(S) : Bradstreet, Jr. et al.

It is certified that error appears in the above-identified patent and that said Letters Patent is hereby corrected as shown below:

On the title page, item [56] References Cited, please add the following references:

--Filer and Stowell Brochure, Milwaukee, Wisconsin, Model CHS HEADRIG CHIPPER, including drawing No. 734816, dated July 17, 1971--.

Signed and Sealed this

Fifth Day of December, 1995

Bruce Lehman

*Attest:*

BRUCE LEHMAN

*Attesting Officer*

*Commissioner of Patents and Trademarks*